US005516045A

United States Patent [19]

Baudin

[11] Patent Number: 5,516,045

[45] Date of Patent: May 14, 1996

[54] PUSHBUTTON INTENDED TO BE FITTED TO A VALVE OR A PUMP EQUIPPING A DISPENSER, AND DISPENSER INCLUDING SUCH A PUSHBUTTON

[75] Inventor: Gilles Baudin, Clichy, France

[73] Assignee: L'Oreal, Paris, France

[21] Appl. No.: 341,591

[22] PCT Filed: May 19, 1993

[86] PCT No.: PCT/FR93/00489

§ 371 Date: Nov. 21, 1994

§ 102(e) Date: Nov. 21, 1994

[87] PCT Pub. No.: WO93/23174

PCT Pub. Date: Nov. 25, 1993

[30] Foreign Application Priority Data

May 21, 1992 [FR] France ..... 92 06215

[51] Int. Cl.[6] ..... B05B 1/26

[52] U.S. Cl. ..... 239/337; 239/543

[58] Field of Search ..... 239/330–333, 239/337, 373, 543, 544; 222/383, 385

[56] References Cited

U.S. PATENT DOCUMENTS

| | | | |
|---|---|---|---|
| 1,957,862 | 5/1934 | Taylor | 239/543 X |
| 2,997,243 | 8/1961 | Kolb | 239/337 |
| 3,045,925 | 7/1962 | Giangualano | 239/544 X |
| 3,406,913 | 10/1968 | Frangos . | |
| 3,767,125 | 10/1973 | Gehres et al. . | |
| 3,785,571 | 1/1974 | Hoening | 239/337 X |
| 4,941,594 | 7/1990 | Montaner et al. | 239/333 X |

FOREIGN PATENT DOCUMENTS

| | | | |
|---|---|---|---|
| 466157 | 1/1992 | European Pat. Off. | 239/543 |
| 907619 | 5/1944 | France | 239/543 |
| 2067520 | 8/1971 | France . | |
| 2553006 | 4/1985 | France . | |
| 7042354 | 4/1971 | Germany . | |

*Primary Examiner*—Kevin P. Weldon
*Attorney, Agent, or Firm*—Young & Thompson

[57] ABSTRACT

The pushbutton (1) for mounting on a valve or a pump of a dispenser enables, by actuation of the pushbutton, liquid contained in a container to be sprayed through at least two spraying nozzles (5, 6) provided in the pushbutton and connected to a central channel (4) of the pushbutton. Each nozzle (5, 6) has an axis (A5, A6) oriented substantially transversally with respect to the axis (A4) of the central channel (4) of the pushbutton. The axes of the spraying nozzles of the pushbutton being situated in the same plane, the axes (A5, A6) of the spraying nozzles form between each other an angle (B, C) between 1° and 40° and the nozzles (5, 6 are supplied by means of two conduits (7, 9) whose axes are parallel.

13 Claims, 3 Drawing Sheets

PUSHBUTTON INTENDED TO BE FITTED TO A VALVE OR A PUMP EQUIPPING A DISPENSER, AND DISPENSER INCLUDING SUCH A PUSHBUTTON

FIELD OF THE INVENTION

The invention relates to a pushbutton, intended to be fitted on a valve or pump equipping a dispenser, to allow, through action on this pushbutton, the liquid contained in the dispenser to be sprayed through at least two spray nozzles provided in the pushbutton and connected to a central channel of this pushbutton, each nozzle having an axis oriented substantially transversely with respect to the axis of the central channel of the pushbutton.

BACKGROUND OF THE INVENTION

U.S. Pat. No. 3,406,913 shows a pushbutton of this type in which two spray orifices with oblique, non-concurrent axes are provided so that the fluid jets ejected through each orifice are tangential or substantially tangential in order to create turbulence capable of breaking up the particles or agglomerations of liquid or of solid.

The German utility model DBGM 70 42 354 describes a pushbutton with two superimposed outlet orifices of parallel axes. The cloud of spray obtained with such a pushbutton needs to be improved, especially as regards its homogeneity and the symmetry in terms of density.

FR-A-2,067,520 describes a pushbutton of which the central channel splits into two separate radial channels located in one and the same plane perpendicular to the central channel and forming between them an angle of 60° to 90° approximately, this arrangement allowing the product to diffuse through a wide solid angle, thus reducing the sweeping motion to be carried out in order to distribute the product.

OBJECT OF THE INVENTION

The object of the invention, above all, is to provide a pushbutton which, while remaining simple and easy to produce, makes it possible to increase the spray impact surface whilst maintaining good distribution, as homogeneous as possible, of the sprayed product, and to obtain a less wetting result.

SUMMARY OF THE INVENTION

To make it possible to achieve this objective, according to the invention, a pushbutton of the sort defined previously, the axes of the spray nozzles of the pushbutton being situated in one and the same plane, is characterized in that the axes of the spray nozzles between them form an angle lying between 1° and 40°, and the nozzles are supplied via two conduits with parallel axes.

The impact surface of the cloud of spray is formed by the intersection of two disks, with a less wetting effect, especially when spraying the hair with lacquer is involved.

For preference, the angle of the axes of the nozzles of the pushbutton lies between 16° and 24°.

Advantageously, the plane of the axes of the spray nozzles is orthogonal to the axis of the central channel of the pushbutton. The nozzles may consist of independent pieces attached to the pushbutton; the axes of the conduits are situated in a plane substantially orthogonal to the axis of the said central channel.

Thus, the angle between the axes exists solely at the orifices of the spray nozzles, whilst the conduits provided in the pushbutton are parallel, which facilitates the molding and demolding operations.

Each conduit communicates with an annular chamber bounded by a post-like element of which the front face, against which the corresponding nozzle rests, is oblique relative to the axis of the conduit in question; the obliqueness of the faces is intended so that the desired angle might be obtained at the nozzles.

The internal face of each nozzle is parallel to the external face of each post-like element of the pushbutton and the orifice of each nozzle has its axis perpendicular to this external face.

The two nozzles may be connected by a middle part and form a single piece.

Each nozzle may include swirl-inducing supply channels which are advantageously positioned such that the supply channels of the pushbutton emerge at equal distances from two swirl-inducing channels, especially for the purpose of producing homogeneous clouds of spray.

For preference, the pushbutton includes, in its middle region, a projecting part pointing toward the inside so as to divide the flow of liquid into two equal parts in order to supply each nozzle with substantially the same flow rate.

The axes of the spray nozzles may be divergent outward or convergent outward.

The invention also relates to a dispenser equipped with a pushbutton as defined before. The invention relates more particularly to a spray dispenser equipped with a pump and intended for spraying hair with lacquer, the pushbutton of the invention making it possible to substantially improve the results obtained with such a dispenser.

BRIEF DESCRIPTION OF THE DRAWINGS

Apart from the provisions explained below, the invention consists in a certain number of other provisions which will be dealt with later with regard to an exemplary embodiment described with reference to the appended drawings, but which is in no way limiting.

Finally.

DETAILED DESCRIPTION OF THE INVENTION

Figure 1:
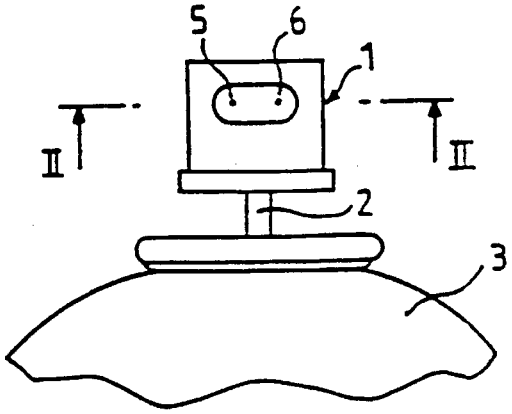
FIG. 1 of these drawings is a diagrammatic elevation of the upper end of a dispenser equipped with a pushbutton in accordance with the invention.
Figure 2:
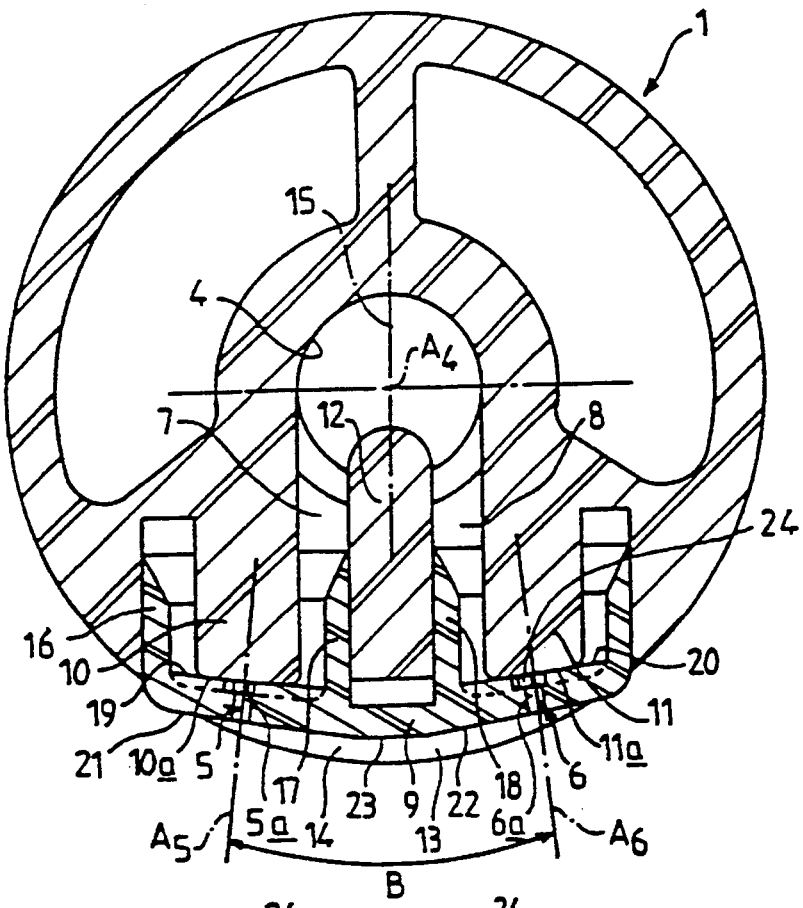
FIG. 2 is a section on the line II—II of FIG. 1.

Referring to the drawings, especially to FIGS. 1 and 2, there can be seen a pushbutton 1 intended to be fitted onto a hollow outlet rod 2 of a valve or of a pump equipping a dispensing container 3. The pushbutton 1, as visible in FIG. 2, includes a central channel 4 in which the rod 2 is engaged in a sufficiently leaktight manner.

The pushbutton 1 includes two spray nozzles 5, 6. By acting on the pushbutton 1, generally by depressing and releasing in succession, it is possible to spray liquid contained in the container 3 through the nozzles 5 and 6.

Each nozzle has its axis A5, A6 oriented transversely with respect to the axis A4 of the central channel 4.

Figure 6:
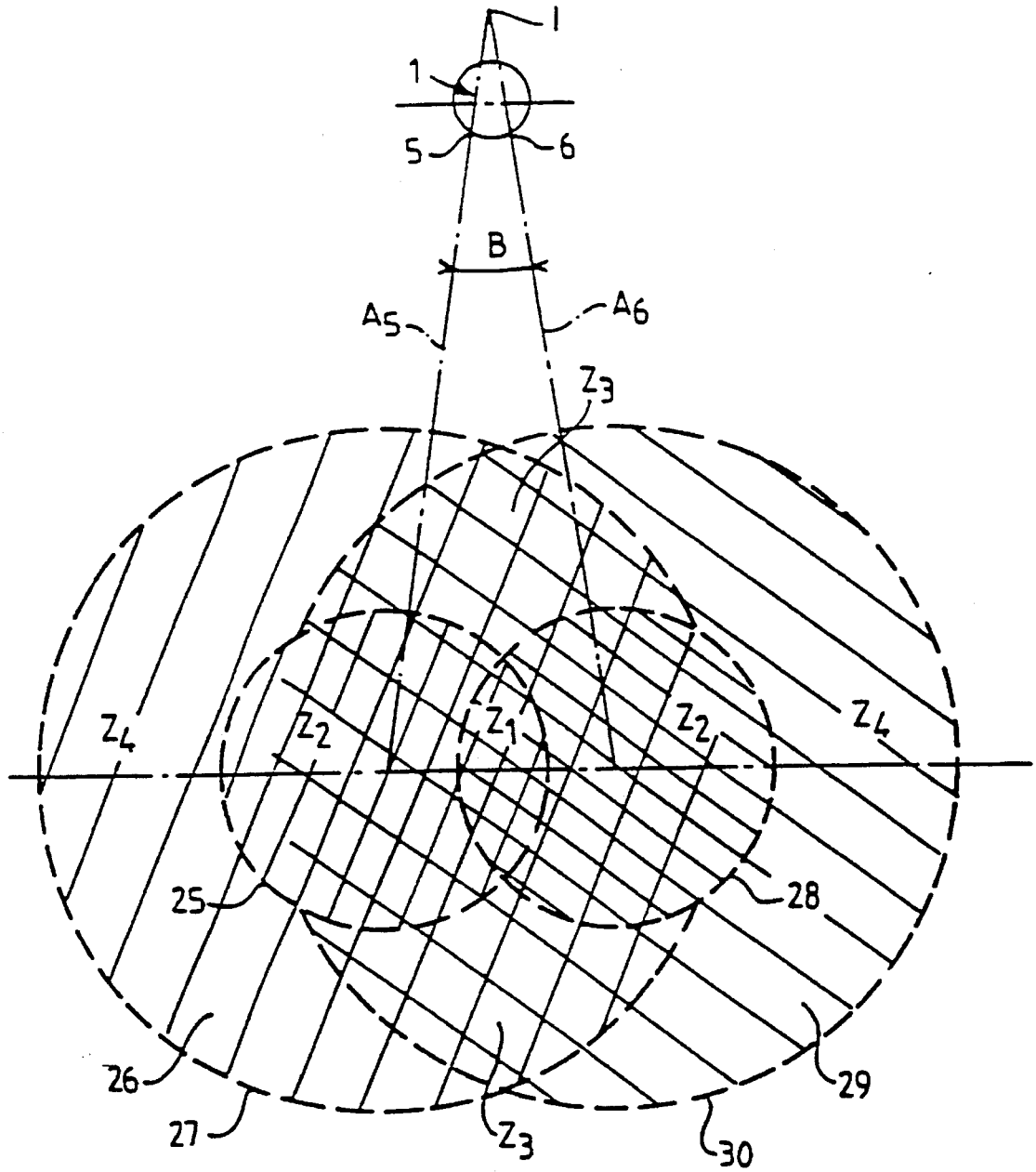
FIG. 6 is a diagram of a section of the cloud of spray.

The axes A5, A6 of the spray nozzles 5 and 6 diverge outward; the axes A5 and A6 are situated in one and the same plane and their extensions, upward according to the representation of FIG. 2, intersect at a point I represented in FIG. 6.

The angle B of divergence formed between the axes A5 and A6 lies between 1° and 40° and preferably lies between 16° and 24°. In the exemplary embodiment represented in FIG. 2, the angle B is substantially equal to 17°.

For preference, the plane of the axes A5, A6 is orthogonal to the axis A4 of the central channel 4.

The nozzles 5 and 6 are supplied by two conduits 7, 8 of parallel axes. The axes of the conduits 7 and 8 are situated in a plane orthogonal to the axis A4. The layout of the conduits 7 and 8 with their axes parallel facilitates the molding and demolding operations for the pushbutton 1.

The nozzles 5 and 6 are provided in pieces attached to the pushbutton 1. Advantageously, as illustrated in FIG. 2, the nozzles 5 and 6 are provided in one and the same attached piece 9.

Figure 5:
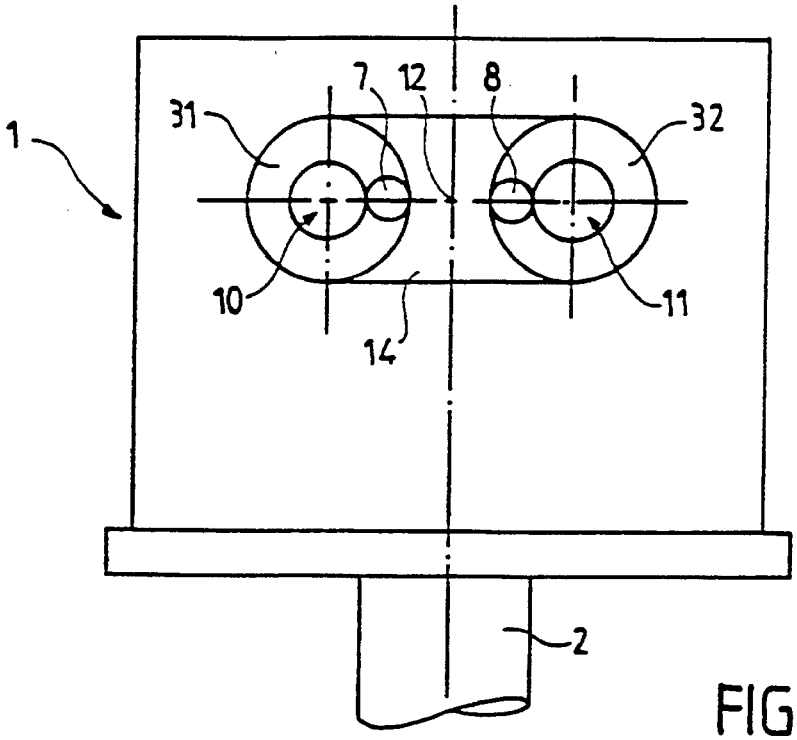
FIG. 5 is an elevation of the pushbutton of FIG. 2, the nozzles having been removed.

The pushbutton 1 includes two elements 10, 11 in the form of posts of circular section (see FIG. 5), generally known as "center posts" which are parallel, the walls of which delimit annular chambers 31, 32 supplied by the conduits 7, 8 (see FIG. 5) communicating with the channel 4 and separated by a middle part 12. The flow of liquid, coming from the channel 4, is thus divided into two equal parts in order to supply each conduit 7, 8 and each nozzle 5, 6 with the same flow rate of liquid.

The elements 10, 11 end externally in a space 13 bounded by the internal walls 14 of a cavity provided in the pushbutton 1.

The front face 10*a*, 11*a* respectively of the posts 10, 11 is not perpendicular to the axes of these posts or to the axes of the conduits 7, 8. The axis 15 of the middle wall 12 is parallel to the axes of the posts 10, 11.

The angle formed by the plane of each front face 10*a*, 11*a* with the plane passing through the axis 15 and the axis A4 is equal to 90° −B/2.

The attached piece 9 includes a peripheral skirt 16 which is inserted into the annular chambers 31, 32 against the walls of these chambers. The piece 9 includes, in its central region, areas of walls 17, 18 which are applied with a slight degree of clamping against the external faces of the middle wall 12.

The piece 9 includes two internal faces 19, 20 situated in different planes and corresponding to the internal faces of the nozzles 5 and 6. The internal face 19 is parallel to the front face 10*a* against which it is applied. Likewise, the internal face 20 is parallel to the front face 11*a* against which it is applied.

The axes A5, A6 of the nozzles are perpendicular respectively to the front faces 10*a*, 11*a* and to the internal faces 19 and 20.

The piece 9 furthermore has two external faces 21, 22 which are parallel to the internal faces 19 and 20, connected via a transition surface 23 orthogonal to the axis 15.

Each nozzle 5, 6 includes a central orifice 5*a*, 6*a* of axis perpendicular to the corresponding internal face 19, 20 of the piece 9. When this piece is engaged in the pushbutton 1, as illustrated in FIG. 1, the orifices 5*a*, 6*a* of the nozzles have their axes A5, A6, perpendicular to the front face 10*a*, 11*a* of the respective post 10, 11.

Figure 3:
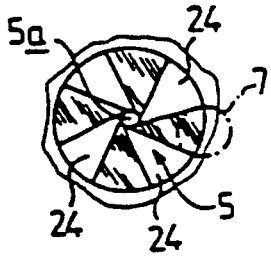
FIGS. 3 and 4 are rear views of the swirl-inducing nozzles.
Figure 4:
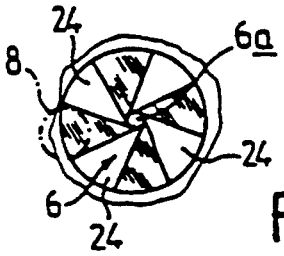

The arrival of fluid in the orifices 5*a*, 6*a* may be ensured by swirl-inducing supply channels such as 24 (see FIGS. 3 and 4) in the form of recesses with a triangular outline made in the internal face 19, 20 orthogonal to the axis of the corresponding orifice 5*a*, 6*a*. The peripheral extent of each channel 24 decreases as it nears the center. The internal radial end of the channel 24 emerges tangentially in the corresponding orifice 5*a*, 6*a*. The channels 24 associated with the nozzle 5*a* may be oriented in the opposite direction from those associated with the nozzle 6*a*. The channels 24 are positioned, about the axes A5, A6 which pass through the centers of the orifices 5*a*, 6*a*, such that the end of each conduit 7, 8 emerges, not in a channel 24, but equi-distant from two channels 24. The presence of swirl-inducing channels 24 makes it possible to generate homogeneous clouds of spray.

It is clear that it would be equally possible to have conventional nozzles with a single orifice, without the presence of swirl-inducing channels.

It should also be noted that the communication between the central channel 4 and the dispensing conduits 7, 8 may be produced tangentially, for example as described and claimed in the Application FR 92 03353 filed on Mar. 20, 1992 in the name of the same Applicant Company.

This being the case, when the user presses on the pushbutton 1 in order to spray liquid contained in the container 3, the two nozzles 5, 6 supplied with substantially the same flow rate of liquid owing to their arrangement and the middle wall 12, each produce a cloud of spray. The two clouds intersect. The impact surface of the clouds together, on a plane orthogonal to the axis 15 and situated approximately 15 cm from the nozzles 5 and 6, is illustrated in FIG. 6.

The impact for the nozzle 5 may be likened to a disk bounded by a circumference 25, corresponding to an area of the cloud relatively laden with droplets. This disk is surrounded by an annular area 26 delimited by a concentric circumference 27. In the annular area 26, or ring, the droplet density is lower.

A similar diagram can be seen for the nozzle 6, with the circumference 28 bounding the laden disk; the ring 29 less laden with droplets is bounded by the circumference 30.

Four areas can be observed in FIG. 6.

An area Z1, in the form of a hi-convex lens, corresponds to the intersection of the circumferences 25 and 28 and to the maximum density of droplets in the cloud of spray.

An area Z2 formed of two parts, corresponds to the areas of the disks 25, 28 outside of one another.

An area Z3, also formed of two parts, corresponds to the part of the intersection of the rings 26 and 29 outside the disks 25, 28.

Finally, an area Z4 consisting of two parts in the form of two extreme crescents corresponds to the non-secant parts of the rings 26 and 29.

The actual, useful, impact surface of the cloud of spray obtained with the nozzle 1 in accordance with the invention is essentially composed of the areas Z1, Z2, Z3. The density in these areas is lower than that of the laden disk of a cloud obtained with a conventional nozzle and with just one orifice for the same overall flow rate of liquid. The pushbutton of the invention therefore produces a less wetting effect, improving the quality with which lacquer is sprayed on hair.

In the exemplary embodiment described hitherto, the axes A5, A6 of the nozzles are divergent outward.

Figure 7:
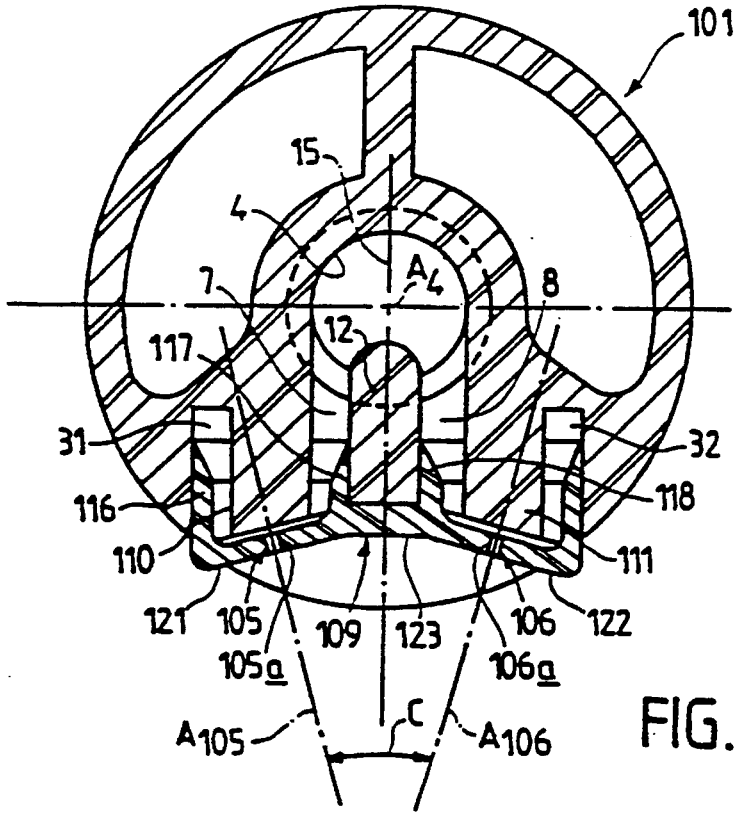
FIG. 7 shows, in a similar way to FIG. 2, a variant embodiment.

FIG. 7 illustrates a variant embodiment of a pushbutton 101, according to which the axes A105, A106 of the nozzles are convergent outward, forming an angle C lying within the same limits of values as those indicated for the angle B.

The elements of the pushbutton 101 of FIG. 7, which are identical or fulfill roles similar to elements already described with regard to FIG. 2, are denoted either by the same numerical references or by the sum of the number 100 and of the numerical reference used beforehand; the description of these elements will not be repeated.

It will be noted that the assembly formed by the face 121, the transition surface 123 and the face 122 is concave forward, while in the case of FIG. 2 this assembly is convex.

The explanations given, especially with regard to FIG. 6, relating to the cloud of spray from the push-button are equally valid for the pushbutton 101 of FIG. 7.

I claim:

1. Pushbutton (1, 101), intended to be fitted on a valve or pump equipping a dispenser, to allow, through action on this pushbutton (1, 101), the liquid contained in the dispenser to be sprayed through at least two spray nozzles (5, 6; 105, 106) provided in the pushbutton (1, 101) and connected to a central channel (4, 104) of this pushbutton (1, 101), each nozzle (5, 6; 105, 106) having an axis (A5, A6; A105, A106) oriented substantially transversely with respect to the axis of the central channel (4, 104) of the pushbutton (1, 101), the axes (A5, A6; A105, A106) of the spray nozzles (5, 6; 105, 106) of the pushbutton (1, 101) being situated in one and the same plane, characterized in that the axes (A5, A6; A105, A106) of the spray nozzles (5, 6; 105, 106) between them form an angle (B, C) lying between 1° and 40° and the nozzles (5, 6; 105, 106) are supplied via two conduits (7, 8) with parallel axes.

2. Pushbutton according to claim 1, characterized in that the angle (B, C) between the axes (A5, A6; A105, A106) lies between 16° and 24°.

3. Pushbutton according to claim 1, characterized in that the plane of the axes (A5, A6; A105, A106) of the spray nozzles (5, 6; 105, 106) is orthogonal to the axis (A4) of the central channel (4) of the pushbutton.

4. Pushbutton according to claim 1, characterized in that the nozzles (5, 6; 105, 106) are separate pieces attached to the pushbutton.

5. Pushbutton according to claim 1, characterized in that the nozzles (5, 6; 105, 106) are connected by a middle part and form a single piece (9, 109).

6. Pushbutton according to claim 4, characterized in that the axes of the conduits (7, 8) are situated in a plane substantially orthogonal to the axis (A4) of the said central channel (4).

7. Pushbutton according to claim 4, characterized in that each conduit (7, 8) communicates with an annular chamber (31, 32) bounded by a post-like element (10, 11; 110, 111) of which the front face (10*a*, 11*a*; 110*a*, 111*a*), against which the corresponding nozzle (5, 6; 105, 106) rests, is oblique relative to the axis of the associated conduit (7, 8), the obliqueness of the faces (10*a*, 11*a*; 110*a*, 111*a*) being intended so that the desired angle (B, C) is obtained at the nozzles (5, 6; 105, 106).

8. Pushbutton according to claim 7, characterized in that the internal face of each nozzle (5, 6; 105, 106) is parallel to the external face (10*a*, 11*a*; 110*a*, 111*a*) of each post-like element (10, 11; 110, 111 of the pushbutton and the orifice (5*a*, 6*a*; 105*a*, 106*a*) of each nozzle has its axis perpendicular to this external face (10*a*, 11*a*; 110*a*, 111*a*).

9. Pushbutton according to claim 1, characterized in that each nozzle (5, 6; 105, 106) includes swirl-inducing supply channels (24).

10. Pushbutton according to claim 9, characterized in that the swirl-inducing supply channels (24) are positioned such that said two conduits (7, 8) of the pushbutton have ends adjacent said supply channels (24) that are disposed equal distances from two swirl-inducing channels, for the purpose of producing homogeneous clouds of spray.

11. Pushbutton according to claim 1, characterized in that the axes (A5, A6) of the spray nozzles (5, 6) diverge outward.

12. Pushbutton according to claim 1, characterized in that the axes (A105, A106) of the spray nozzles (105, 106) converge in a direction outwardly of said pushbutton.

13. Dispenser equipped with a container and intended for spraying hair with lacquer, characterized in that the dispenser is equipped with a pushbutton according to claim 1.

* * * * *